US006988642B2

(12) United States Patent
Gallo, Jr. et al.

(10) Patent No.: US 6,988,642 B2
(45) Date of Patent: Jan. 24, 2006

(54) TAMPER-EVIDENT DISPENSER BOTTLE

(75) Inventors: Anthony B. Gallo, Jr., Warren, NJ (US); Douglas M. Lund, Hillsborough, NJ (US); Gary A. Meade, Ewing, NJ (US); Rocco Palaia, Middlesex, NJ (US)

(73) Assignee: Johnson & Johnson Consumer Companies, Skillman, NJ (US)

( * ) Notice: Subject to any disclaimer, the term of this patent is extended or adjusted under 35 U.S.C. 154(b) by 299 days.

(21) Appl. No.: 10/283,032

(22) Filed: Oct. 29, 2002

(65) Prior Publication Data

US 2004/0079765 A1 Apr. 29, 2004

(51) Int. Cl.
*B65D 47/20* (2006.01)

(52) U.S. Cl. ..... 222/506; 222/541.6; 222/153.01; 222/548; 215/235; 220/253

(58) Field of Classification Search ..... 222/506, 222/541.6, 153.01, 485, 548; 215/235, 237; 220/253

See application file for complete search history.

(56) References Cited

U.S. PATENT DOCUMENTS

| | | | | |
|---|---|---|---|---|
| 2,131,078 A | * | 9/1938 | Thorn | 222/506 |
| 2,870,935 A | | 1/1959 | Houghtelling | |
| 3,194,455 A | * | 7/1965 | Castelli | 222/545 |
| 3,260,422 A | * | 7/1966 | Fillmore et al. | 222/485 |
| 3,260,423 A | * | 7/1966 | Fillmore et al. | 222/485 |
| 3,342,385 A | * | 9/1967 | Knight | 222/485 |
| 3,666,138 A | | 5/1972 | Morris, Jr. et al. | |
| 3,946,896 A | | 3/1976 | Lemelson | |
| 3,990,603 A | | 11/1976 | Brochman | |
| 3,990,615 A | | 11/1976 | Kerwin et al. | |
| 4,022,464 A | * | 5/1977 | Parker | 222/485 |
| 4,113,103 A | | 9/1978 | Carlsson | |
| 4,299,339 A | | 11/1981 | Giroux et al. | |
| 4,434,903 A | | 3/1984 | Cooke | |
| 4,437,593 A | | 3/1984 | Bullock, III | |

(Continued)

FOREIGN PATENT DOCUMENTS

| | | |
|---|---|---|
| CA | 1258657 | 8/1989 |
| CA | 1284128 | 5/1991 |
| CA | 2047916 | 2/1992 |
| CA | 1303521 | 6/1992 |
| CA | 1319334 | 6/1993 |

(Continued)

OTHER PUBLICATIONS

European Search Report dated Jan. 12, 2004 for EP 03 25 6783.

*Primary Examiner*—David A. Scherbel
*Assistant Examiner*—Melvin A. Cartagena

(57) ABSTRACT

A dispenser bottle and associated closure has a sifter disposed in the neck thereof, either in the form of castellated vents formed in the interior peripheral edge of the neck or a separate sifter element. A rotatable cap is positioned over the sifter. The cap has holes that align with the vents or holes in the sifter to dispense material from the bottle. A removable lock ring is removeably conjoined to the cap to evidence tampering. One embodiment employs a squeeze tab that is depressed to open the bottle thereby increasing the dexterity required for opening. Another embodiment employs a rotatable sifter that must be held by one hand while the cap is held and rotated relative to the sifter by the other hand. A detent provides resistance to opening.

33 Claims, 11 Drawing Sheets

U.S. PATENT DOCUMENTS

| | | | | |
|---|---|---|---|---|
| 4,467,931 | A | | 8/1984 | Gach |
| 4,487,324 | A | | 12/1984 | Ostrowsky |
| 4,524,876 | A | | 6/1985 | Kusz |
| 4,548,331 | A | * | 10/1985 | Montgomery ..... 220/253 |
| 4,555,038 | A | | 11/1985 | Nagel, Jr. |
| 4,557,398 | A | | 12/1985 | Hambleton et al. |
| 4,613,063 | A | * | 9/1986 | Wright ..... 222/153.14 |
| 4,648,520 | A | | 3/1987 | Stull |
| 4,723,391 | A | | 2/1988 | Ashley et al. |
| 4,763,804 | A | | 8/1988 | O'Connell |
| 4,782,964 | A | | 11/1988 | Poore et al. |
| 4,828,127 | A | | 5/1989 | Young et al. |
| D304,424 | S | | 11/1989 | Dawson |
| 4,941,592 | A | | 7/1990 | Kitterman |
| 4,969,574 | A | | 11/1990 | Shastal |
| 4,984,700 | A | | 1/1991 | Knickerbocker |
| 5,040,692 | A | | 8/1991 | Julian |
| 5,100,011 | A | | 3/1992 | Maietta |
| 5,111,947 | A | | 5/1992 | Patterson |
| 5,123,561 | A | | 6/1992 | Gross |
| 5,141,138 | A | | 8/1992 | Odet et al. |
| 5,145,080 | A | | 9/1992 | Imbery, Jr. |
| 5,147,054 | A | | 9/1992 | Pehr |
| 5,183,171 | A | | 2/1993 | Pherigo |
| 5,201,440 | A | | 4/1993 | Gross |
| 5,213,224 | A | | 5/1993 | Luch |
| 5,261,548 | A | * | 11/1993 | Barker et al. ..... 215/230 |
| 5,292,019 | A | | 3/1994 | Patterson |
| 5,320,233 | A | | 6/1994 | Welch |
| 5,339,993 | A | | 8/1994 | Groya et al. |
| 5,356,018 | A | | 10/1994 | Dubach |
| 5,356,020 | A | | 10/1994 | Thompson |
| 5,388,731 | A | | 2/1995 | Mengeu et al. |
| D358,769 | S | | 5/1995 | Luch et al. |
| D360,134 | S | | 7/1995 | Snyder |
| 5,450,972 | A | | 9/1995 | Zemlo |
| 5,456,374 | A | | 10/1995 | Beck |
| 5,464,112 | A | | 11/1995 | Guillot |
| 5,480,045 | A | | 1/1996 | Molinaro et al. |
| 5,487,481 | A | | 1/1996 | Sander et al. |
| 5,494,200 | A | | 2/1996 | Sheffler et al. |
| D370,845 | S | | 6/1996 | Sherman et al. |
| 5,551,608 | A | | 9/1996 | Moore et al. |
| D381,906 | S | | 8/1997 | Bartsch |
| 5,671,853 | A | | 9/1997 | Herr |
| 5,680,968 | A | | 10/1997 | Moore |
| 5,785,213 | A | | 7/1998 | Guillot |
| 5,865,330 | A | | 2/1999 | Buono |
| 5,875,908 | A | | 3/1999 | Witt et al. |
| 5,884,790 | A | | 3/1999 | Seidita |
| D407,645 | S | | 4/1999 | Mogard |
| D410,843 | S | | 6/1999 | Mogard |
| D411,744 | S | | 6/1999 | Brach et al. |
| 5,913,435 | A | | 6/1999 | Fuchs |
| D414,698 | S | | 10/1999 | Mogard et al. |
| D415,962 | S | | 11/1999 | Garcia |
| 5,975,368 | A | | 11/1999 | Wood |
| 6,003,712 | A | | 12/1999 | Mogard et al. |
| 6,056,136 | A | | 5/2000 | Taber et al. |
| 6,059,134 | A | | 5/2000 | Long, Jr. |
| 6,112,921 | A | | 9/2000 | Robinson |
| 6,119,883 | A | | 9/2000 | Hock et al. |

FOREIGN PATENT DOCUMENTS

| | | |
|---|---|---|
| CA | 1321775 | 8/1993 |
| CA | 2099145 | 12/1993 |
| CA | 2106884 | 3/1994 |
| CA | 2118622 | 9/1994 |
| CA | DES 74896 | 10/1994 |
| CA | DES 74897 | 10/1994 |
| CA | DES 74898 | 10/1994 |
| CA | DES 74902 | 10/1994 |
| CA | DES 74903 | 10/1994 |
| CA | DES 75098 | 11/1994 |
| CA | 2160429 | 4/1996 |
| CA | 2229928 | 3/1997 |
| CA | 2235250 | 10/1998 |
| CA | 85834 | 2/1999 |
| CA | 2261017 A1 | 8/1999 |
| CA | 2037417 | 2/2003 |
| DE | 7540150 | 5/1976 |
| DE | 29508769 | 6/1995 |
| WO | WO 97/23388 A1 | 7/1997 |

* cited by examiner

TAMPER-EVIDENT DISPENSER BOTTLE

FIELD OF THE INVENTION

The present invention relates to dispenser bottles and more particularly to dispenser bottles for flowable material, such as powder, that have a sifter and a cap with apertures therein which are opened and closed by rotating the cap relative to the sifter.

BACKGROUND OF THE INVENTION

Conventional bottles for holding talcum powder, foot powder, baby powder, etc. have a rotatable cap with apertures and an internal sifter with apertures. In an opened position, the apertures in the cap align with the apertures in the sifter and permit the powder to be dispensed. In a closed position, the cap apertures are rotated away from alignment with the sifter apertures such that the powder is retained in the bottle. The opened and closed positions of the conventional powder bottle cap are determined by stop lugs provided on the neck of the bottle and internal stop lugs provided on the cap. Although these known powder caps effectively retain the product when it is not in use, such caps lack tamper-evident and child-resistant features.

Various foodstuff products, such as milk, employ tamper-evident caps that provide consumers with a readily-recognizable assurance that the product has not been altered. Tamper-evident caps typically utilize a tear strip having internal teeth that mate with teeth provided on or near the neck of the bottle, such that the cap of the bottle cannot be rotated to remove the cap until the tear strip is removed.

Child-resistant press-and-twist caps for securing threaded lids to a threaded bottle neck are widely used in the pharmaceutical industry, and in other applications, e.g., see U.S. Pat. No. 6,112,921 to Robinson. The Robinson '921 patent discloses a cap with depressable panels which abut against stops provided proximate to the neck of the bottle when closed. When the panels are depressed, they move out of alignment with the stop, allowing the lid to be unthreaded from the bottle neck. The closure disclosed in Robinson '921 is not tamper evident and would not be suitable for a powder dispenser bottle, in that the closure is threaded and removable, rather than rotationally limited between an opened and closed position. The closure of Robinson '921 does not have dispensing apertures.

It would be desirable to have a sifter-type dispenser bottle having an opened and a closed position, and thus suitable for dispensing flowable material such as powder which is tamper-resistant and/or child resistant.

SUMMARY OF THE INVENTION

The problems and disadvantages associated with conventional dispenser bottles are overcome by the present invention which includes a dispenser bottle for containing and selectively dispensing a flowable material having a bottle portion with an outlet through which the flowable material passes when dispensed from the dispenser bottle. A cap covers the outlet and has a cap hole therein. The cap is rotatable relative to the outlet between an opened position wherein the cap hole is aligned with the outlet allowing the flowable material to pass therethrough, to a closed position wherein the cap hole is out of alignment with the outlet preventing the flowable material from passing therethrough. Means, such as retainer beads are provided for retaining the cap covering the outlet when in the closed position and when in the opened position. A cap lock is attached to at least one of the cap and/or the bottle portion. The cap lock has a locked position preventing the rotation of the cap relative to the outlet and an unlocked position wherein the cap is unconstrained by the cap lock from rotating relative to the outlet.

In accordance with a second embodiment of the present invention, a dispenser bottle for containing and selectively dispensing a flowable material has a bottle portion with an outlet therein. A sifter having a generally cylindrical side wall, an open end and a dispensing end with a sifter opening therein is rotatably coupled to the bottle at the open end in communication with the outlet. A cap is coaxially and rotatably coupled to the sifter on the dispensing end, the cap having a cap hole therein and being rotatable relative to the sifter between an opened position wherein the cap hole is aligned with the sifter opening and a closed position wherein the cap hole is not aligned with the sifter opening.

In accordance with a third embodiment of the present invention, a closure for selectively dispensing a flowable material through an outlet in the neck of a bottle having a stop disposed on an outer surface thereof proximate the neck has a cap covering the outlet. The cap has an occluder plate with a cap hole therein and a peripheral wall depending at substantially right angles from the occluder plate. The peripheral wall slidably coaxially embraces the neck, with the cap being rotatable relative to the outlet between an opened position wherein the cap hole is aligned with the outlet allowing the flowable material to pass therethrough to a closed position wherein said cap hole is out of alignment with the outlet preventing the flowable material from passing therethrough, said cap having a squeeze tab depending therefrom, said squeeze tab having a relaxed position and a depressed position, said squeeze tab abutting the rotation stop in the relaxed position to prevent rotation of said cap from said closed position, said squeeze tab clearing the rotation stop when in the depressed condition allowing said squeeze tab and said cap to rotate past said rotation stop to said opened position. Means for retaining the cap covering the outlet when in the closed position and when in the opened position are provided.

In accordance with a fourth embodiment of the present invention, a dispenser bottle for containing and selectively dispensing a flowable material includes a bottle portion with a neck defining an outlet through which the flowable material passes when dispensed from the dispenser bottle. An arcuate rail is disposed on the bottle portion proximate the neck with a spacing therebetween defining an arcuate track. A stop rail extends from the arcuate rail toward the neck. A cap covers the outlet and has an occluder plate with a cap hole therein and a peripheral wall depending at substantially right angles from the occluder plate, the peripheral wall slidably coaxially embracing the neck. The cap is rotatable relative to the outlet between an opened position wherein the cap hole is aligned with the outlet allowing the flowable material to pass therethrough to a closed position wherein the cap hole is out of alignment with the outlet preventing the flowable material from passing therethrough. The cap has a squeeze tab depending therefrom with a relaxed position and a depressed position. The squeeze tab abuts against the arcuate rail when in the relaxed condition preventing rotation of the cap. In the depressed condition, the squeeze tab enters the arcuate track between the arcuate rail and the neck enabling the cap to be rotated to the opened position. The stop rail limits the rotation of the cap when the squeeze tab abuts the stop rail. Means are provided for retaining the cap covering the outlet when in the closed position and when in the opened position.

In accordance with a fifth embodiment of the present invention, a dispenser bottle for containing and selectively dispensing a flowable material has a bottle portion with a neck defining an outlet through which the flowable material passes when dispensed from the dispenser bottle. The bottle has a rotation stop extending from an outer surface thereof proximate the neck. A cap covers the outlet, having an occluder plate with a cap hole therein and a peripheral wall depending at substantially right angles from the occluder plate. The peripheral wall slidably coaxially embraces the neck and the cap is rotatable relative to the outlet between an opened position wherein the cap hole is aligned with the outlet allowing the flowable material to pass therethrough to a closed position wherein the cap hole is out of alignment with the outlet preventing the flowable material from passing therethrough. The cap has a squeeze tab depending therefrom with a relaxed position and a depressed position. The squeeze tab abuts the rotation stop in the relaxed position to prevent rotation of the cap from the closed position. The squeeze tab clears the rotation stop when in the depressed condition, allowing the squeeze tab and the cap to rotate past the rotation stop to the opened position. Means are provided for retaining the cap covering the outlet when in the closed position and when in the opened position.

A sixth embodiment of the present invention includes a closure for selectively dispensing a flowable material through an outlet in a bottle. The closure has a sifter portion with a generally cylindrical side wall, an open end and a dispensing end with a sifter opening therein. The sifter is rotatably coupled to the bottle at the open end in communication with the outlet thereof. A cap is coaxially and rotatably coupled to the sifter on the dispensing end. The cap has a cap hole therein and is rotatable relative to the sifter portion between an opened position wherein the cap hole is aligned with the sifter opening and a closed position wherein the cap hole is not aligned with the sifter opening.

The dispenser bottle of the present invention not only effectively stores and dispenses flowable material such as powder, but it also may provide consumer desirable child-resistant and/or tamper-evident security features.

BRIEF DESCRIPTION OF THE FIGURES

For a better understanding of the present invention, reference is made to the following detailed description of an exemplary embodiment considered in conjunction with the accompanying drawings, in which.

DESCRIPTION OF THE PREFERRED EMBODIMENTS

Figure 1:
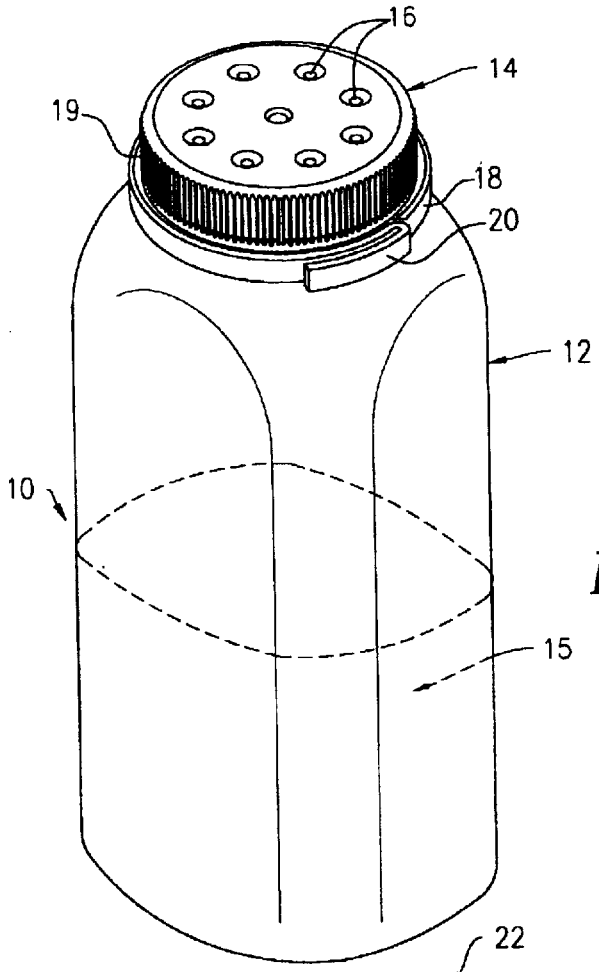
FIG. 1 is a perspective view of a dispenser bottle in accordance with a first embodiment of the present invention.
Figure 2:
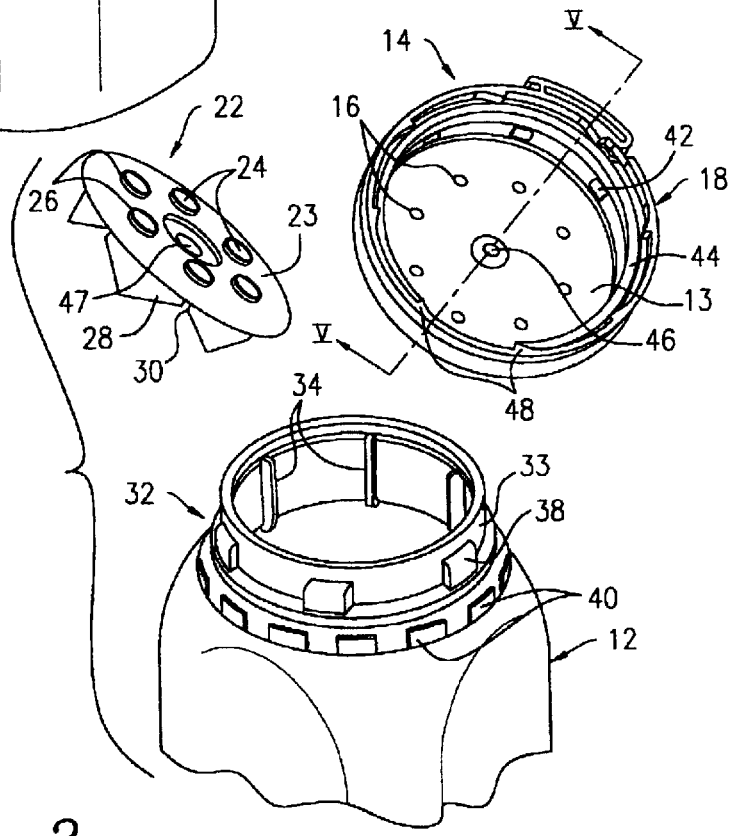
FIG. 2 is an exploded perspective view of the upper portion of the dispenser bottle of FIG. 1.

FIGS. 1 and 2 show a dispenser bottle 10 having a bottle portion 12 and a cap 14. The cap 14 has an occluder plate 13, a plurality of cap holes 16 through which the contents 15 of the dispenser bottle 10, e.g., baby powder, is dispensed. The shape of the occluder plate 13 may be substantially planar in shape or alternatively may be curved. A tamper-evident lock ring 18 is provided at an edge of a depending peripheral wall 19 proximate to the bottle portion 12 and retains the cap 14 in a predetermined angular position relative to the bottle portion 12, i.e., in a closed position, keeping the contents 15 within the bottle portion 12. The lock ring 18 has a pull tab 20 to assist a user in removing the lock ring 18 which is preferably attached to the cap 14 via a thin, frangible, plastic junction that tears when the pull tab 20 is pulled.

Figure 3:
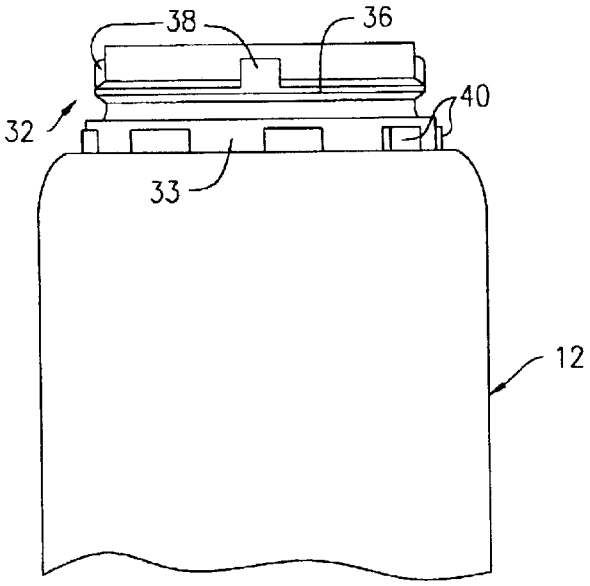
FIG. 3 is a side view of the dispenser bottle of FIGS. 1 and 2 without a cap.

FIG. 2 shows sifter 22 having an occluder plate 23 with a plurality of sifter holes 24, each surrounded by a peripheral seal ring 26. A plurality of teeth 28 project from the bottom of the occluder plate 23 spaced by tooth spaces 30. The sifter 22 is positioned in the bottle neck 32 with the tooth spaces 30 receiving sifter alignment beads 34 which project inwardly from the bottle neck 32. The sifter holes 24 are distributed on the surface of the occluder plate 23 such that they have the same distribution pattern as the cap holes 16. This permits the cap holes 16 to align with the sifter holes 24 when the cap 14 is rotated into an open position. Conversely, when the cap holes 16 are rotated out of alignment with the sifter holes 24, the bottle 10 is closed. The seal rings 26 aid in sealing the sifter holes 24 against the cap 14 when the cap 14 is in a closed position. FIGS. 2 and 3 show that the bottle neck 32 is provided with a cap retainer bead 36, a plurality of stop lugs 38 and a plurality of ratchet lugs 40. The cap retainer bead 36 retains the cap 14 in snap-fit relationship to the bottle portion 12, namely, by interacting with cap bead 44. A pivot bead 46 extending downwardly from the cap 14 is received within a mating pivot indentation 47 provided in the sifter 22. The lock ring 18 has a plurality of inwardly projecting locking teeth 48 that engage the ratchet lugs 40 provided on the bottle neck 32, preventing the cap 14 from being turned relative to the bottle portion 12 when the lock ring 18 is in place.

Figure 4:
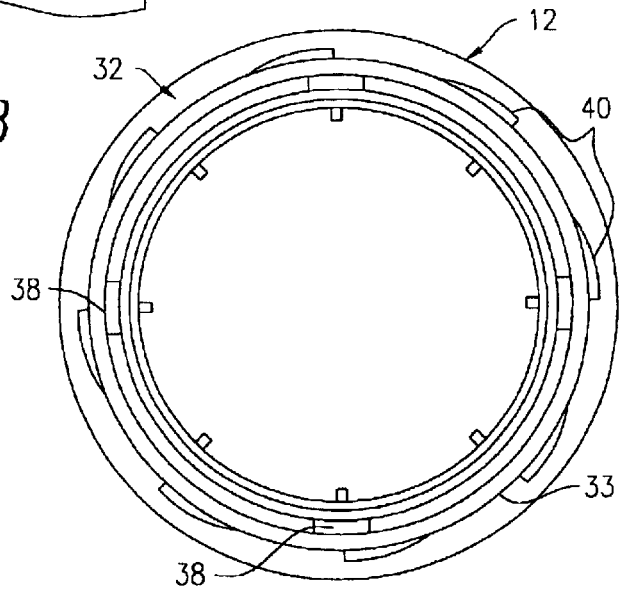
FIG. 4 is a top view of the dispenser bottle of FIG. 3.
Figure 5:
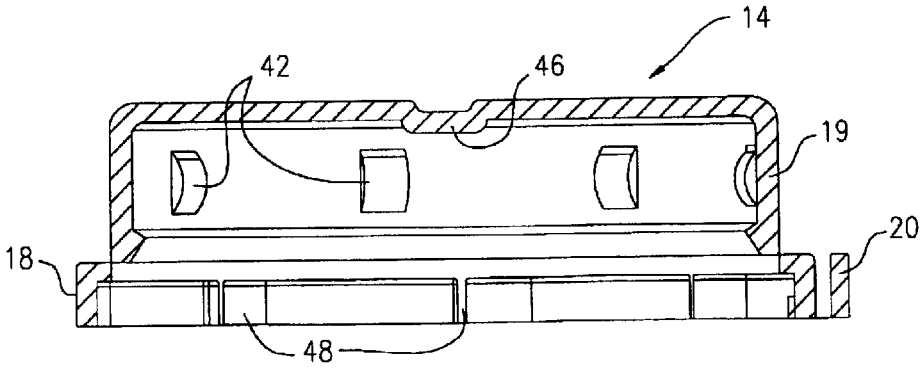
FIG. 5 is a cross-sectional view of the cap of the dispenser bottle of FIG. 2, taken along section lines V—V and looking in the direction of the arrows.

FIGS. 4 and 5 show that the ratchet lugs 40 ramp outwardly from an exterior surface 33 of the bottle neck 32, such that the cap 14 may be rotated to a closed position (clockwise) even with the tamper evident lock ring 18 conjoined with the cap 14. As shown in FIG. 2, the locking teeth 48 of the lock ring 18 are complementary in shape to the ratchet lugs 40 and interdigitate therewith when the cap 14 is on the bottle portion 12. The ratchet lugs 40 prevent the lock ring 18 from being rotated in the counterclockwise (opening) direction. (As is clear to one of normal skill in the art, the opening and closing directions could be opposite to those recited herein, viz., clockwise to open and counterclockwise to close. Further, the lock ring 18 could be mounted to the bottle portion 12 proximate the neck 32 and the ratchet lugs 40 provided on the cap 14.) FIG. 4 also shows the plurality of stop lugs 38 disposed around the periphery of the bottle neck 32. As noted above, the stop lugs 38 limit the clockwise and counterclockwise motion of the cap 14 to a selected total number of degrees of displacement, e.g., 22.5 degrees, with the extremes of this range of motion corresponding to the opened and closed positions.

FIG. 5 shows that the cap 14 has a plurality of cap lugs 42 which are spaced around the interior periphery of the cap 14. The cap lugs 42 interact with (abut against) the stop lugs 38 on the neck 32 to limit the range of rotational motion of the cap 14 between the opened and closed positions.

Figure 6:
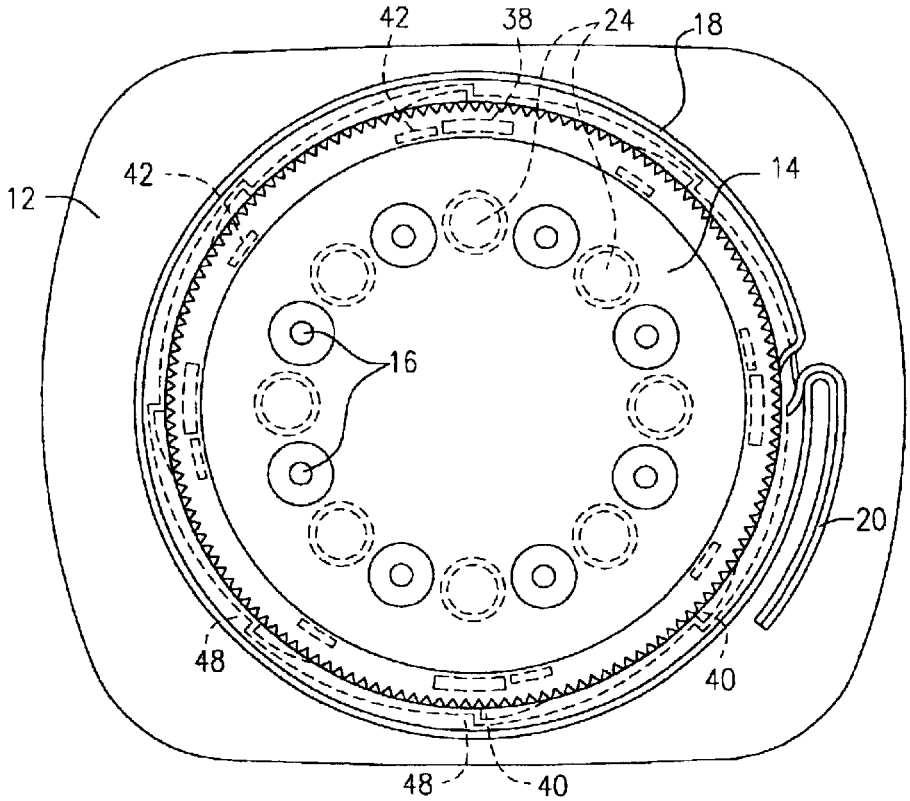
FIG. 6 is a diagrammatic top view of the dispenser bottle shown in FIGS. 1 through 5 in a closed position.

FIG. 6 shows the cap 14 installed upon the bottle portion 12 in a closed position with the lock ring 18 in place. Half of the cap lugs 42 are rotated against and abut the stop lugs 38 on the bottle neck 32 in a clockwise direction. In this position, the sifter holes 24 are out of alignment with the cap holes 16. The locking teeth 48 engage the ratchet lugs 40, preventing the cap 14 from being rotated in a counterclockwise direction.

Figure 7:
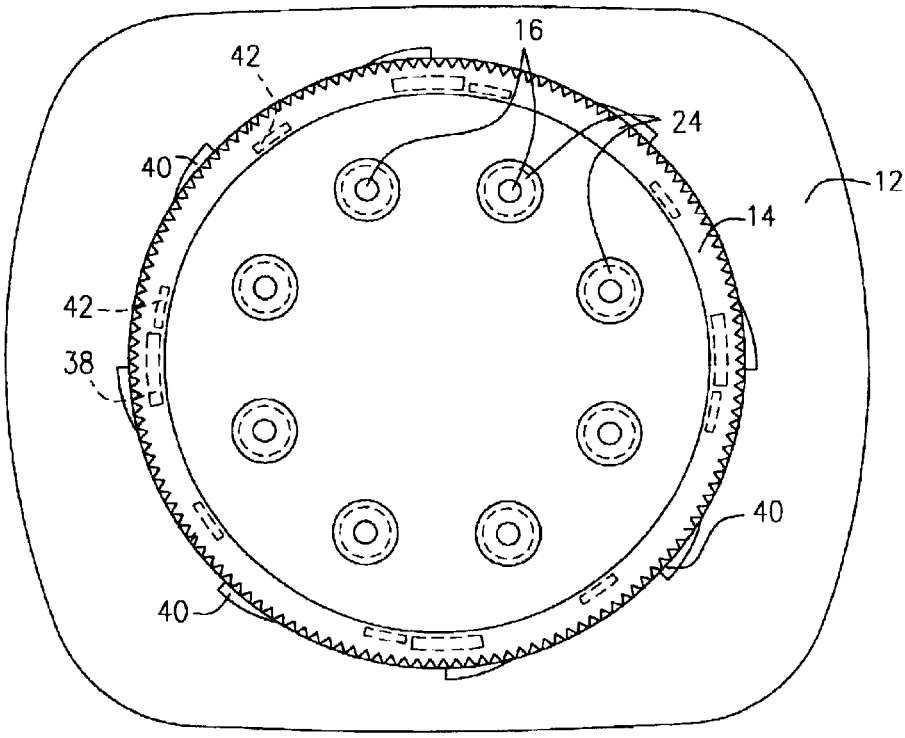
FIG. 7 is a diagrammatic top view of the dispenser bottle shown in FIGS. 1 through 6 in an open position.

FIG. 7 shows the cap 14 in place on the bottle portion 12 but with the lock ring 18 removed and the cap 14 rotated counterclockwise such that the cap holes 16 align with the sifter holes 24. Comparing FIG. 7 to FIG. 6, it can be appreciated that the cap lugs 42 have been rotated counterclockwise such that they encounter the stop lugs 38 from the counterclockwise direction. There are eight cap lugs 42 shown in FIGS. 6 and 7 and four stop lugs 38. As can be appreciated, of each sequential pair of cap lugs 42 positioned between sequential stop lugs 38, a first abuts a stop lug 38 in the clockwise direction when the cap 14 is closed and a second abuts a stop lug 38 in a counterclockwise direction when the cap 14 is open. As would be known by one of normal skill in the art to which this invention pertains, a different number of stop lugs 38 and cap lugs 42 could be used to achieve the functionality described above, i.e., to establish a limited range of motion to provide for opened and closed positions.

Elements illustrated in FIGS. 1 to 7 which correspond in form and function to elements described below with respect to FIGS. 8 to 25 have been designated by corresponding reference numerals increased by 100, 200 and 300, respectively.

Figure 8:
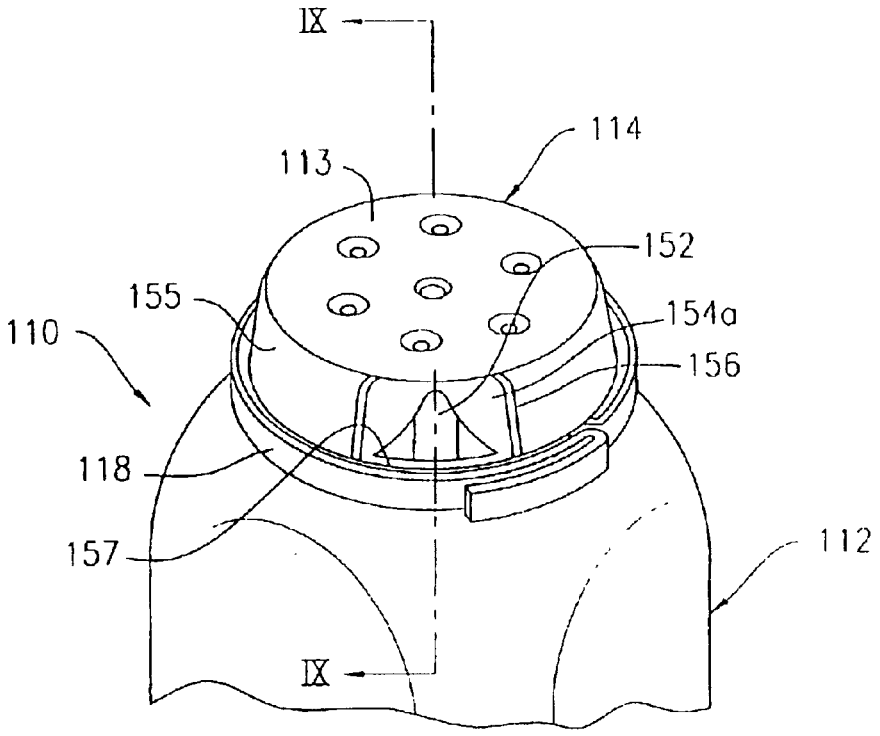
FIG. 8 is a perspective view of a dispenser bottle in accordance with a second exemplary embodiment of the present invention.
Figure 9:
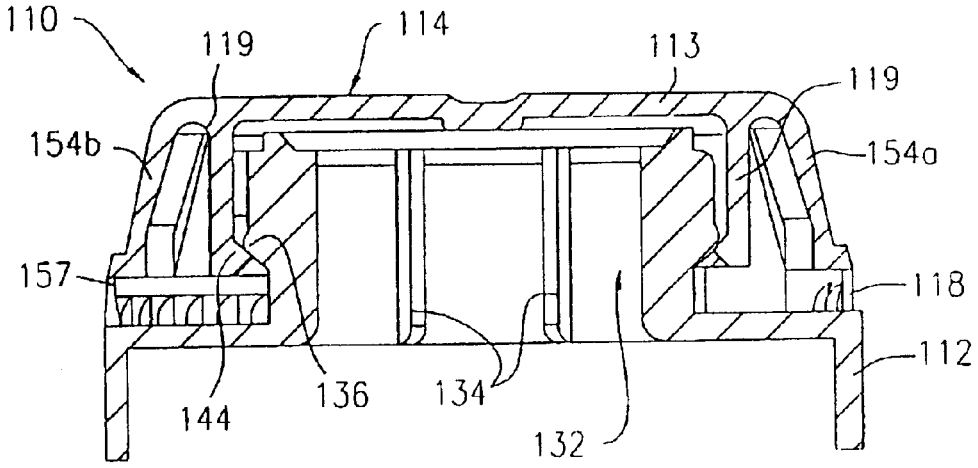
FIG. 9 is a cross-sectional view of the dispenser bottle of FIG. 8, taken along section lines IX—IX and looking in the direction of the arrows.

FIG. 8 shows an alternative embodiment of the present invention, viz., dispenser bottle 110 having bottle portion 112 and cap 114. The cap 114 has finger indentations 152 which tactilely provide a signal to the user of the bottle 110 to place opposing fingers in the finger indentations 152. The finger indentations 152 are associated with a pair of squeeze tabs 154*a*, 154*b* (see FIG. 9) positioned at opposing orientations on the cap 114. The squeeze tabs 154*a*, 154*b* are defined by slits 156 in an outer peripheral skirt 155 depending from occluder plate 113. A tamper-evident lock ring 118 prevents the cap 114 from being rotated. In addition, the lock ring 118 prevents the squeeze tabs 154*a*, 154*b* from being depressed, as they are integrally formed with the lock ring 118, i.e., joined at a frangible junction 157.

FIGS. 9–13 show that the cap 114 is retained on the bottle portion 112 by a cap retainer bead 136 which interacts with a cap bead 144 on peripheral wall 119 of the cap 114. As in the previous embodiment, the dispenser bottle 110 employs a sifter of the same type as sifter 22 shown in FIG. 2. The sifter 22 has been deleted from the drawings of FIGS. 8 through 14 for ease of illustration, but would occupy the same position as was shown and described relative to FIGS. 1 through 7, viz., in the bottle neck 132 aligned by sifter alignment beads 134.

Figure 10:
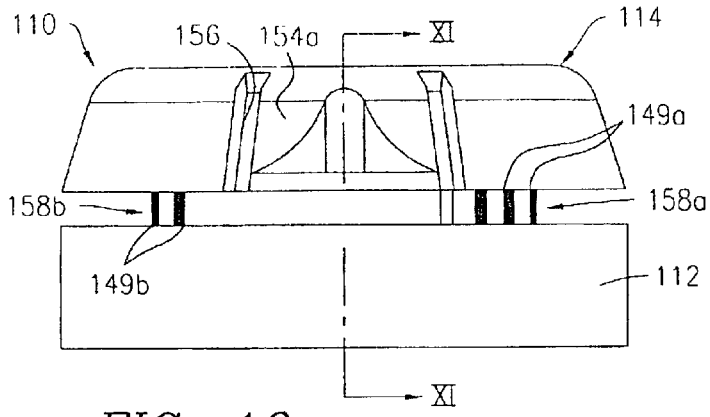
FIG. 10 is a side view of the dispenser bottle shown in FIGS. 8 and 9 with the tamper-evident locking strip removed.
Figure 11:
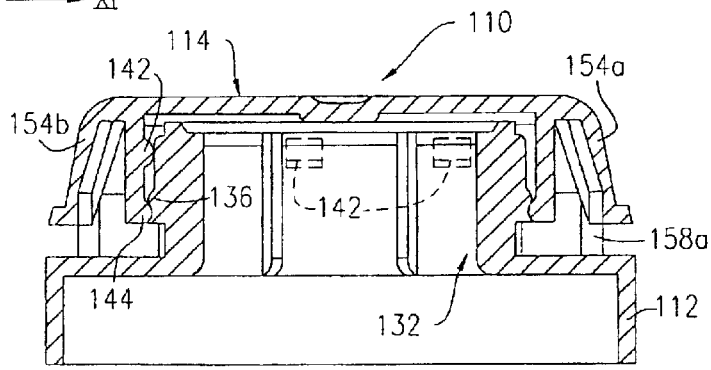
FIG. 11 is a cross-sectional view of the dispenser bottle shown in FIG. 10 taken along section line XI—XI and looking in the direction of the arrows.

FIGS. 10 and 11 show the dispenser bottle 110 after the lock ring 118 has been removed. When in place, the lock ring 118 engages with ratchet teeth 149*a*, 149*b* provided on stops 158*a*, 158*b*, (see FIGS. 10, 12 and 13). Removal of the lock ring 118 also permits the squeeze tabs 154*a*, 154*b* to be depressed relative to the remainder of the cap 114 due to the slits 156. As shown in FIG. 11, in the rest position, the squeeze tabs 154*a*, 154*b* are in abutting relationship to rotation stops 158*a*, 158*b* such that the cap 114 cannot be rotated in the counterclockwise (opening) direction without depressing the squeeze tabs 154*a*, 154*b*. Only stop 158*a* is visible in FIG. 11.

Figure 12:
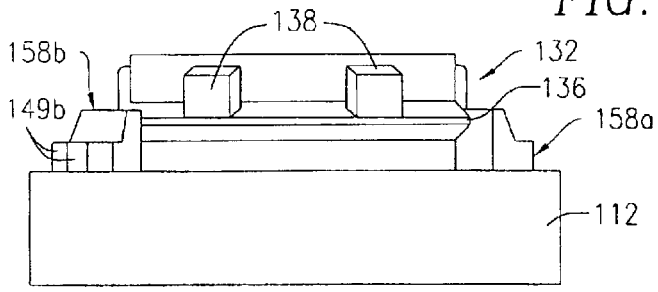
FIG. 12 is a side view of the dispenser bottle of FIGS. 8 through 11 with the cap removed.
Figure 13:
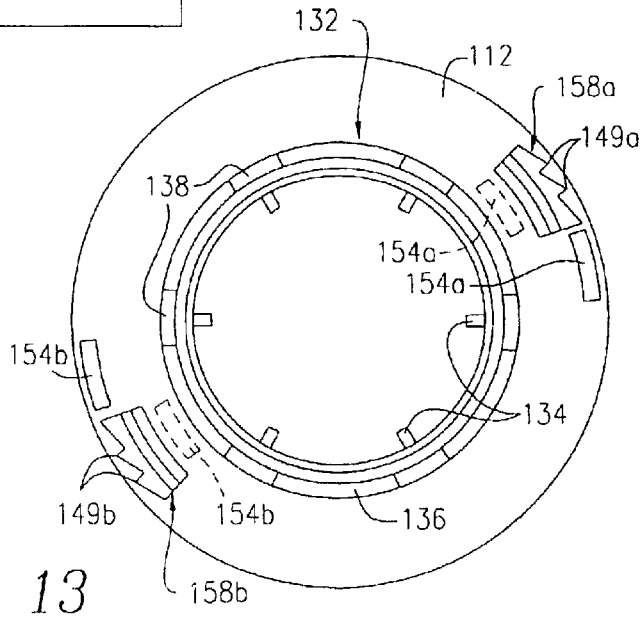
FIG. 13 is a top view of the dispenser bottle of FIG. 12.

FIGS. 12 and 13 illustrate the position of stops 158*a*, 158*b* on the bottle portion 112 proximate to the bottle neck 132. Each stop 158*a*, 158*b* has ratchet teeth 149*a*, 149*b*, respectively, that engage the lock ring 118. FIG. 13 diagrammatically illustrates the opened (depressed) and closed (relaxed) position of the squeeze tabs 154*a*, 154*b* (dotted lines representing open position). In the closed position, the squeeze tabs 154*a*, 154*b* abut stops 158*a*, 158*b* preventing counterclockwise rotation. In the opened position, the squeeze tabs 154*a*, 154*b* have been depressed inwardly such that they clear the stops 158*a*, 158*b*, permitting counterclockwise rotation and the alignment of the cap holes 116 with the sifter holes 124, as shown in FIGS. 6 and 7 for the previous embodiment. Since the squeeze tabs 154*a*, 154*b* are positioned between the stops 158*a*, 158*b* and the bottle neck 132, the stops 158*a*, 158*b* are clearly visible in front of the squeeze tabs 154*a*, 154*b*, when the dispenser bottle 110 is viewed from the side, providing a visual indicator that the dispenser bottle 110 is open. This visual indicator can be enhanced by utilizing contrasting colors for the stops 158*a*, 158*b* and the squeeze tabs 154*a*, 154*b*. The cap lugs 142 (see FIG. 11) and stop lugs 138 (see FIG. 12) interact in the same manner as in the embodiment shown in FIGS. 1–8.

The present invention, as described and shown in relation to FIGS. 8 through 14 provides a dispenser bottle 110 that has a tamper-evident lock ring 118 that prevents the bottle 110 from being opened prior to removal of the lock ring 118. Further, after the lock ring 118 has been removed from the dispenser bottle 110, the squeeze tabs 154*a*, 154*b* must be depressed and the cap 114 simultaneously turned to open the bottle 10. The degree of manual dexterity required to open the bottle 110 is therefore increased over that required to open a conventional sifter-type dispenser bottle. While there is no guarantee that a child, such as a toddler or even a baby, would not have the manual dexterity to operate the squeeze tabs 154*a*, 154*b* and open the dispenser bottle 110, these features do provide a barrier for opening that is likely to require more dexterity and time for the operator to overcome, thereby increasing the opportunity for an adult to intervene. Furthermore, the overlapping squeeze tabs 154*a*, 154*b* and stops 158*a*, 158*b* provide a visual indicator that the bottle is opened, preventing an open bottle 110 from being stored on the shelf, leading to contamination of the bottle 110 by moisture and/or inadvertently spilling the contents of the bottle 110 due to tipping the bottle 110 over, e.g., while it is stored on a shelf.

Figure 14:
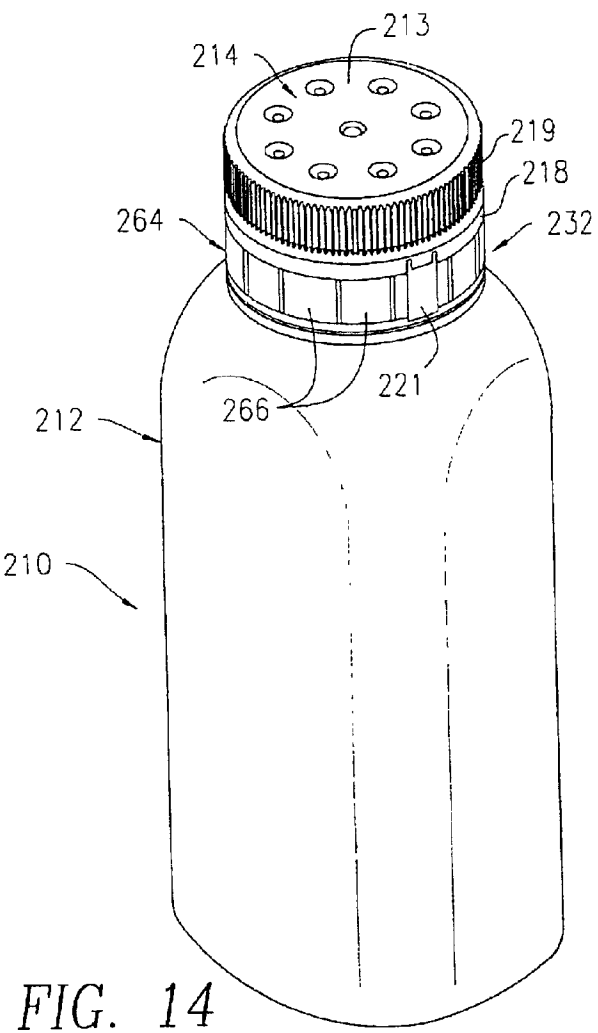
FIG. 14 is a side view of a dispenser bottle in accordance with a third exemplary embodiment of the present invention.

FIG. 14 shows yet another embodiment of the present invention viz., dispenser bottle 210 utilizing cap 214 and bottle portion 212. A rotatable sifter cap 264 (See FIGS. 18–20) is inserted between the cap 214 and the bottle portion 212. The rotatable sifter cap 264 snaps onto the bottle neck 232 and is rotatable at all times relative to the bottle portion 212. When a locking ring 218 is in place on the cap 214, the cap 214 with occluder plate 213 and peripheral wall 219 is conjoined to the rotatable sifter cap 264, such that they rotate on the bottle neck 232 as a unit. A different type of pull tab 221 is illustrated in FIG. 14 for aiding in removal of the lock ring 218. The rotatable sifter cap 264 has finger grip pads 266 for enhancing the grip on the rotatable sifter cap 264 to aid in turning the cap 214 relative to the rotatable sifter cap 264, as more fully described below.

Figure 15:
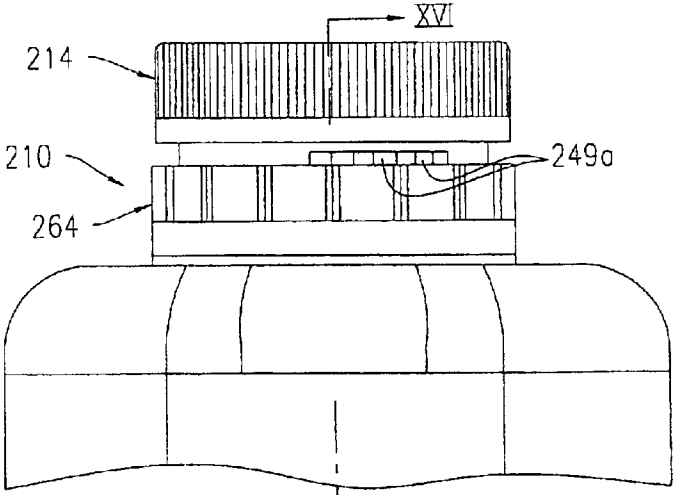
FIG. 15 is a side view of the dispenser bottle of FIG. 14 with the locking strip removed.

FIG. 15 shows the dispenser bottle 210 with the lock ring 218 removed from the cap 214. A plurality of locking teeth 249*a*, 249*b* (only 249*a* visible in FIG. 15) are provided on the rotatable sifter cap 264 that engage with mating locking teeth 248 (see FIG. 21) provided on the tamper evident lock ring 218. When the locking ring 218 is in place on the cap 214, the cap 214 cannot be rotated relative the rotatable sifter cap 264. When the lock ring 218 is removed from the cap 214, the cap 214 can then be rotated relative to the rotatable sifter cap 264.

Figure 16:
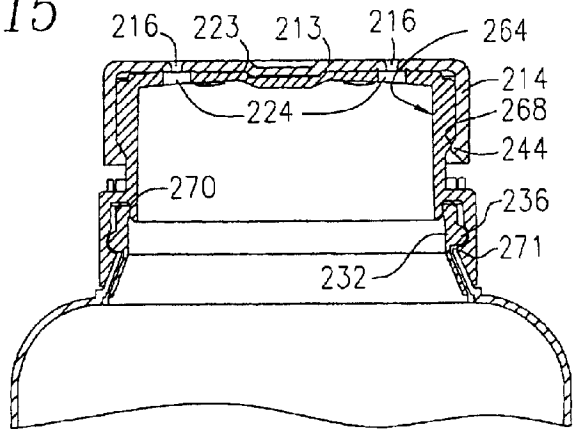
FIG. 16 is a cross-sectional view of the dispenser bottle of FIG. 15 taken along section lines XVI—XVI and looking in the direction of the arrows.

As shown in FIG. 16, the cap 214 is retained on the rotatable sifter cap 264 by a cap bead 244 that clips over a cap retainer bead 268 present on the rotatable sifter cap 264. A guide flange 270 inserts within an upper portion of the neck 232 and a sifter retainer bead 236 retains rotatable sifter cap 264 in association with the bottle portion 212 by interacting with sifter bead 271 which clips thereover. A crab claw swipe 272 (see FIG. 19) is provided on the rotatable sifter cap 264 proximate guide flange 270 such that it seals against the upper edge 235 (see FIG. 22) of the bottle neck 232. The rotatable sifter cap 264 has a plurality of sifter holes 224 in the sifter occluder plate 223 and the cap 214 has a plurality of cap holes 216 in the occluder plate 213. As before, the dispenser bottle 210 is opened and closed depending upon the relative alignment or misalignment of the cap holes 216 and sifter holes 224.

Figure 17:
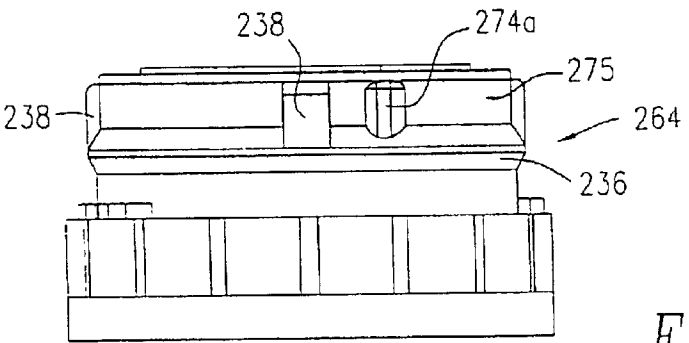
FIG. 17 is a side view of a sifter cap utilized in the dispenser bottle of FIGS. 14 through 16.
Figure 18:
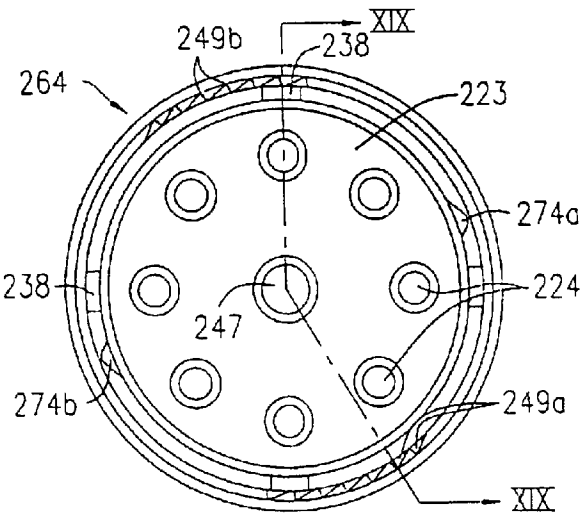
FIG. 18 is a top view of the sifter cap shown in FIG. 17.

FIGS. 17 and 18 show the rotatable sifter cap 264 having a plurality of stop lugs 238 that function in conjunction with cap lugs 242 (see FIG. 21) for limiting the motion of cap 214 relative to the rotatable sifter cap 264. More particularly, the stop lugs 238 and cap lugs 242 establish an opened position and a closed position for the cap 214 relative to the rotatable sifter cap 264. Detents 274*a*, 274*b* are provided on substantially cylindrical side wall 275 of the rotatable sifter cap 264 to frictionally interact with the cap lugs 242 to provide a surmountable resistance that may be overcome to change from the opened state to the closed state and vice versa, as described further below. As an alternative, the detents 274*a*, 274*b* could be formed as part of the cap 214 and interact with stop lugs 238 to provide a surmountable resistance to a change of position of the cap 214. The detents 274*a*, 274*b* may be provided with a more gradual slope in either the clockwise or counterclockwise directions to make it easier to close than to open the dispenser bottle 210 or vice versa. In FIG. 18, the locking teeth 249*a*, 249*b* provided on the rotatable sifter cap 264 are visible, as are the sifter holes 224 and pivot indentation 247.

Figure 19:
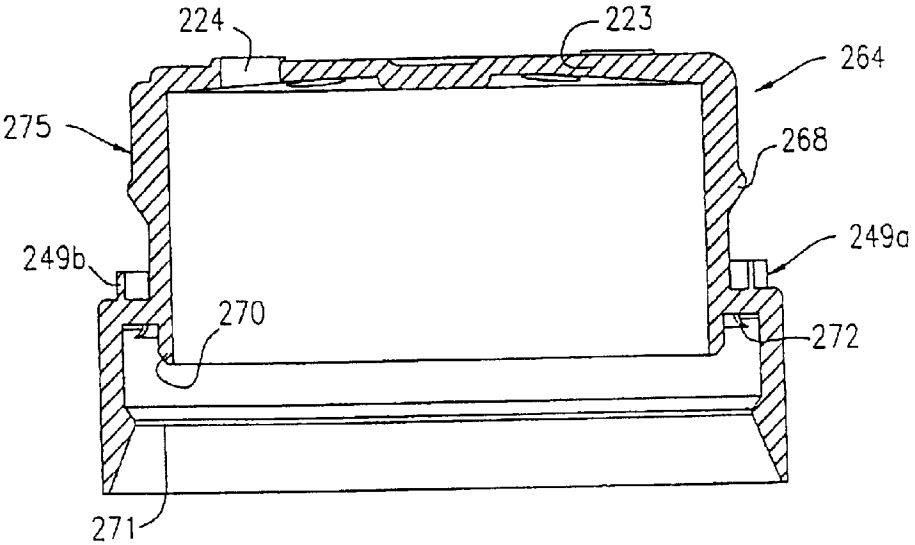
FIG. 19 is a cross-sectional view of the sifter cap shown in FIG. 18 taken along section line XIX—XIX and looking in the direction of the arrows.

FIG. 19 shows the crab claw swipe 272 extending in an downwardly direction from the rotatable sifter cap 264 proximate guide flange 270.

Figure 21:
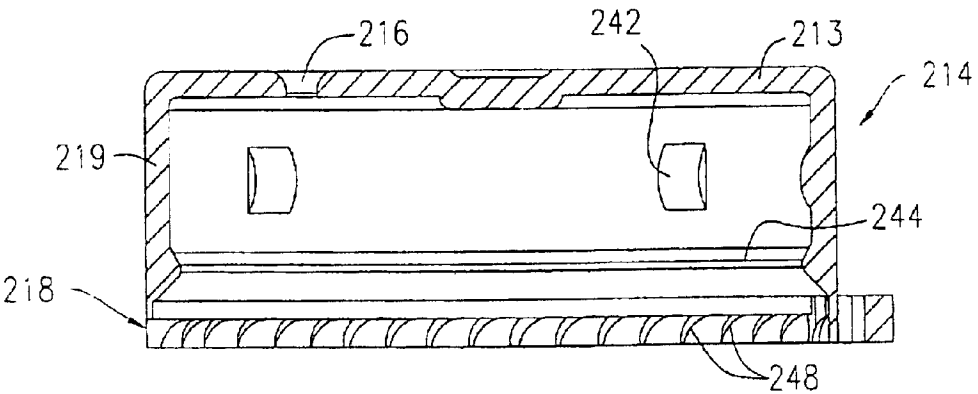
FIG. 21 is a cross-sectional view of the cap of dispenser bottle of FIG. 20, taken along section line XXI—XXI and looking in the direction of the arrows.
Figure 20:
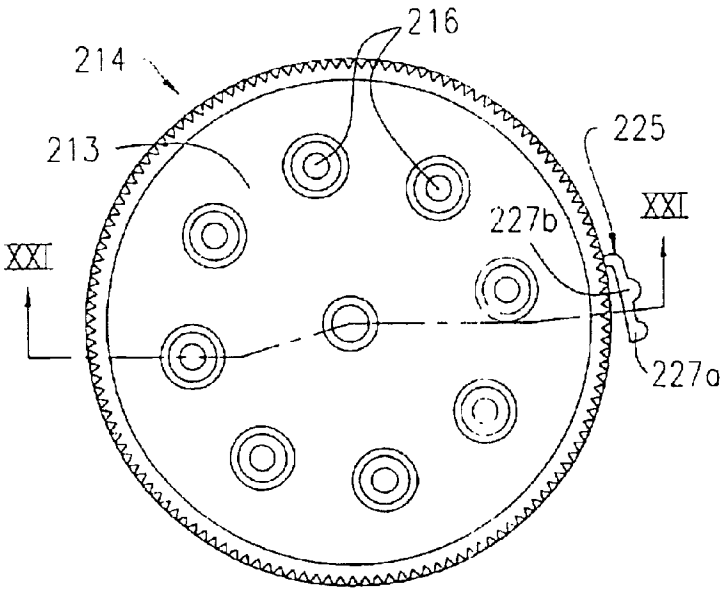
FIG. 20 is a top view of a cap for the dispenser bottle shown in FIGS. 14 through 19, but with an alternative pull tab.

FIGS. 20 and 21 show the cap 214, which is generally of the same form and function as caps 14, 114 of the preceding embodiments and utilizes cap lugs 242 for limiting the motion of the cap 214 relative to the rotatable sifter cap 264. Locking ring 218 is attached to peripheral wall 219 of the cap 214 by a thin, frangible junction. The cap 214 and locking ring 218 are preferably monolithically formed from a polymer material such as a polyolefin, e.g., polyethylene or polypropylene.

Figure 22:
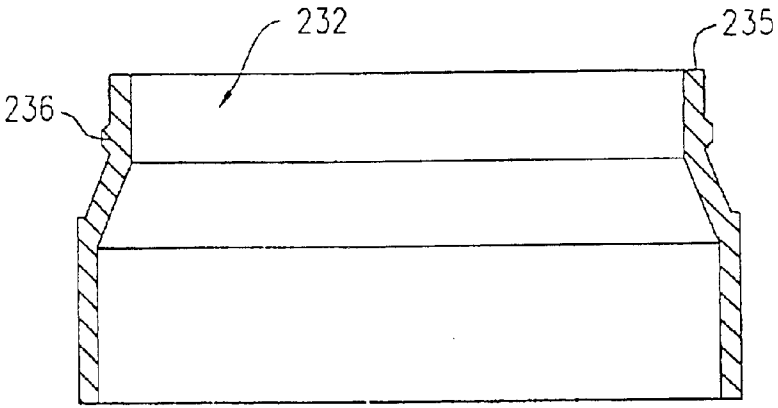
FIG. 22 is a cross-sectional view of the neck portion of the dispenser bottle shown in FIG. 15.

FIGS. 21 and 22 show a pull tab 225 which has a pair of gripping beads 227*a*, 227*b*.

FIG. 22 shows the sifter retainer bead 236 which retains the rotatable sifter cap 264 on the bottle neck 232.

Figure 23:
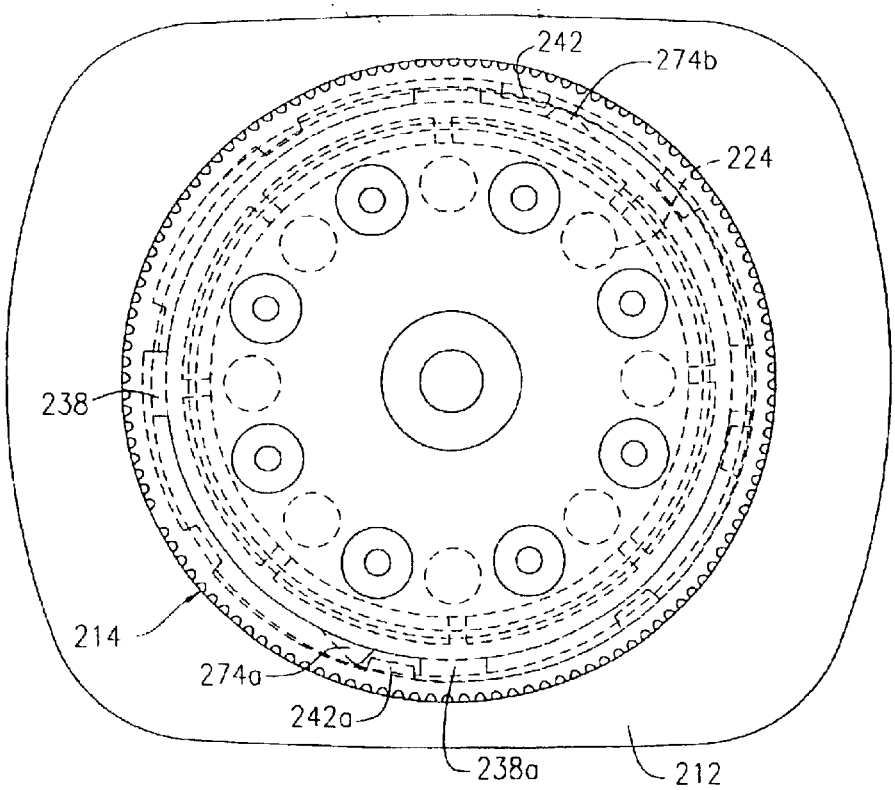
FIG. 23 is a diagrammatic view of the dispenser bottle of FIGS. 14 through 22 with the cap in a closed position.
Figure 24:
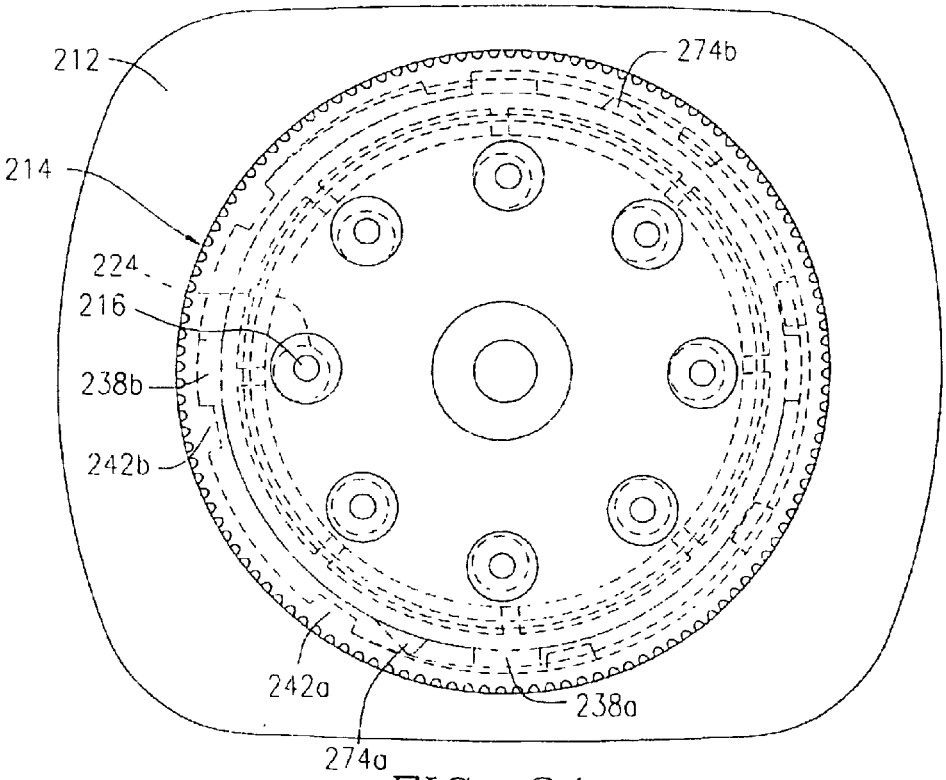
FIG. 24 is a diagrammatic view of the dispenser bottle of FIGS. 14 through 23 with the cap in an open position.

FIG. 23 shows the cap 214 on the bottle portion 212 in a closed position. This open position may be maintained by the presence of the lock ring 218 (see FIG. 21) or may be maintained by one or more detents 274*a*, 274*b*. In a closed position, the cap holes 216 are out of alignment with the sifter holes 224 and the cap lugs 242 are rotated in a counterclockwise direction such that they abut associated stop lugs 238 provided on the bottle neck 232. In order to rotate the cap 214 to the open position, the detents 274*a*, 274*b* provided on the bottle neck 232 must be overridden by the cap lugs 242. For example, the cap lug 242*a* in FIG. 24 is positioned between stop lug 238*a* and detent 274*a* in the closed position. In order to be rotated in a clockwise direction, the cap lug 242*a* would encounter the detent 274*a* with relatively little clockwise rotation and would have to override the detent 274*a* to proceed to an open position, that is, with the cap lug 242*b* abutting stop lug 238*b*, as shown in FIG. 24. The open state is shown in FIG. 24 wherein the cap 214 is in an open position, such that the cap holes 216 align with the sifter holes 224. Cap lug 242*a* has passed detent 274*a* and cap lug 242*b* abuts stop lug 238*b*.

Figure 25:
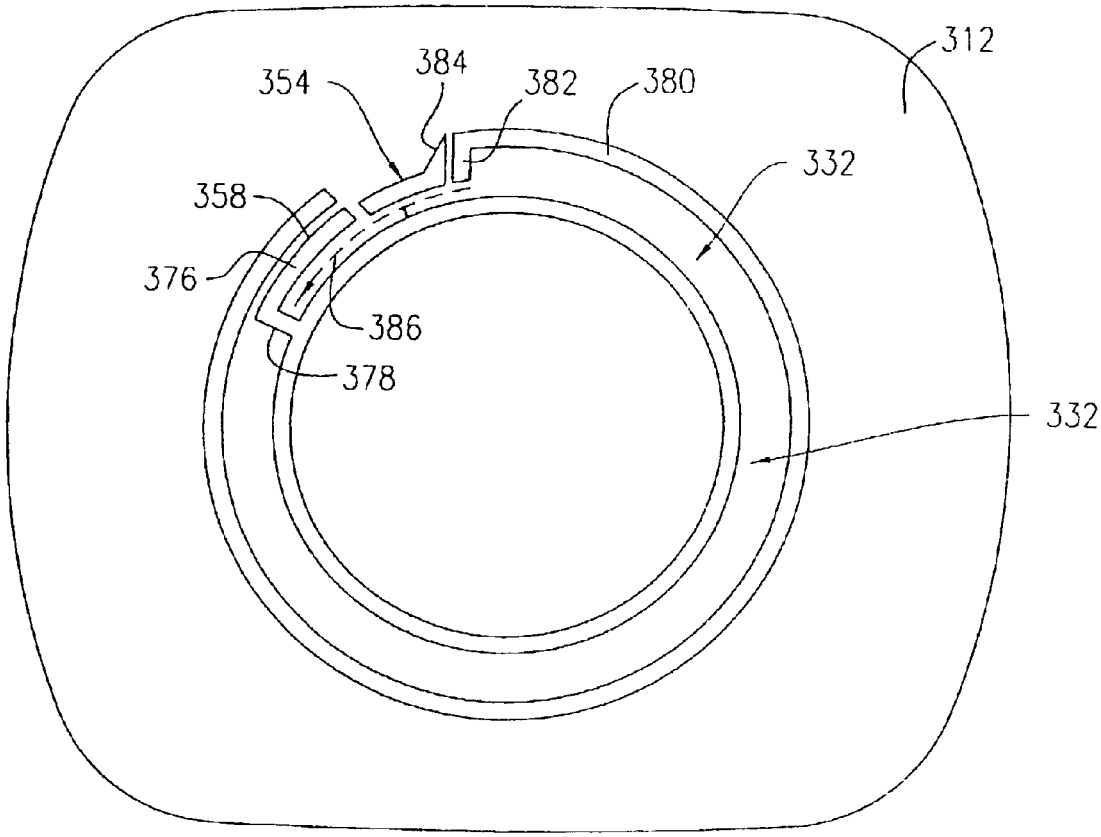
FIG. 25 is a diagrammatic view of a dispenser bottle in accordance with a fourth exemplary embodiment of the present invention.

FIG. 25 shows a fourth embodiment of the present invention wherein a squeeze tab 354 depending from a cap (not shown but having a configuration and operation substantially like cap 114 of FIGS. 8 through 11) fits upon a bottle portion 312 and bottle neck 332. More particularly, stop 358 has an "L"-shape with an arcuate rail 376 and a radial stop rail 378. In a closed position, the undeflected squeeze tab 354 abuts against the arcuate rail 376 in the counterclockwise direction (in this instance, the opening direction) and/or against an outer peripheral wall 380. The outer peripheral wall 380 has an inwardly directed radial abutment 382 and the squeeze tab 354 is provided with an abutment extension 384. The radial abutment 382 and the abutment extension 384 prevent the squeeze tab 354 from being rotated in a clockwise direction, in both the deflected and undeflected states. Alternatively, the clockwise rotation of the squeeze tab can be limited by stop lugs like those described above, e.g., 238, 242. When the squeeze tab 354 is deflected inwardly, the squeeze tab 354 may be rotated counterclockwise into the blind slot/track 386 formed by the arcuate rail 376 the radial stop rail 378 and the neck 332. Once in the slot 386, the radial stop rail 378 and/or the abutment extension 384 prevents the squeeze tab 354 (and associated cap—not shown) from rotating further, thereby stopping the cap (like cap 114) in an open position. As before, the directions associated with opening and closing can be reversed from that described above. Another squeeze tab 354 and slot 386 may be formed opposite to the one shown, if desired.

Figure 26:
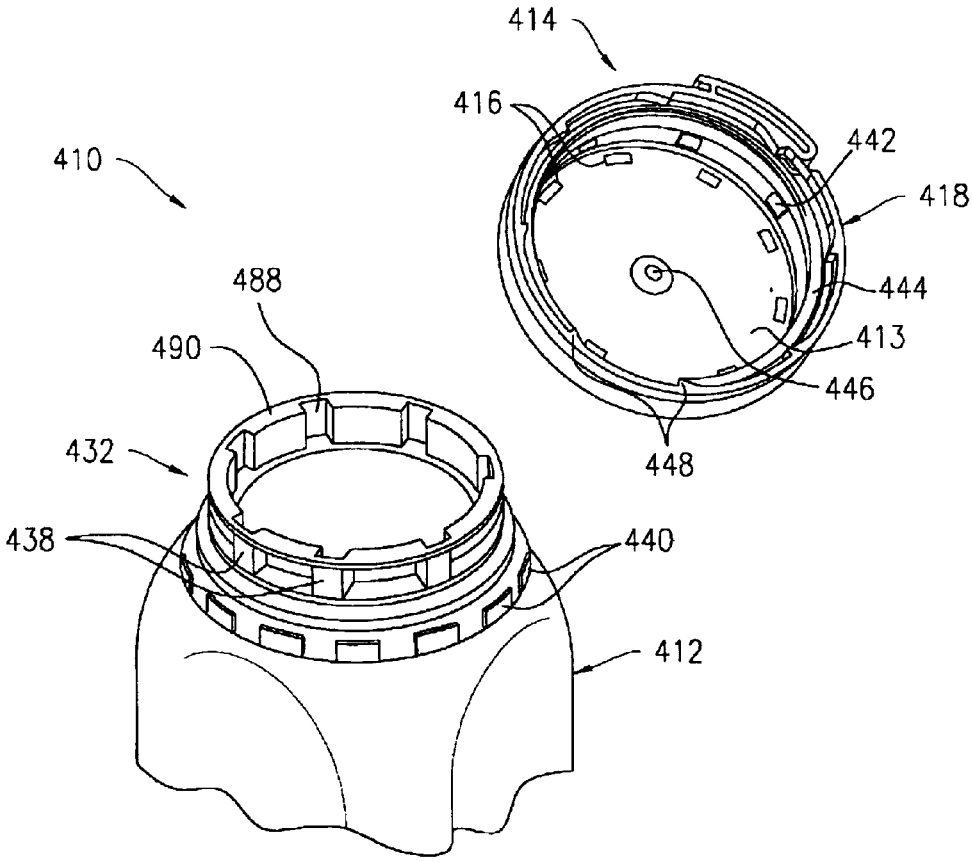
FIG. 26 is an exploded, perspective view of a dispenser bottle in accordance with a fifth exemplary embodiment of the present invention.
Figure 27:
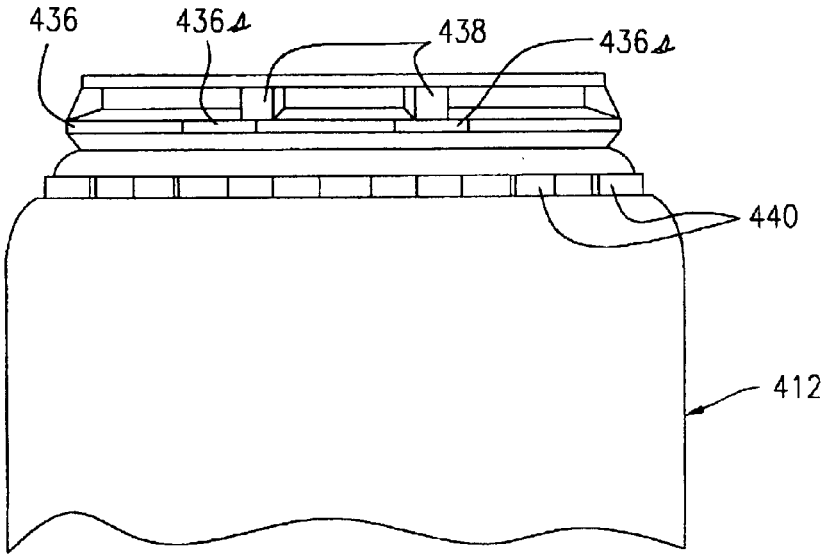
FIG. 27 is a side view of the dispenser bottle of FIG. 26 without a cap.

FIGS. 26 and 27 show a dispenser bottle 410 having a similar configuration and features as those shown in the dispenser bottle 110 shown in FIGS. 1–7, with the exception that no separate sifter 22 (FIG. 2) is utilized. Instead, the bottle neck 432 is castellated with a plurality of radially oriented vents 488 on an inner peripheral surface thereof. A sealing flange 490 may be provided for aiding in creating a powder tight seal with the cap occluder plate 413. A plurality of generally rectangularly shaped cap holes 416 penetrate the occluder plate 413. Powder may be dispensed from the bottle 412 when the cap 414 is rotated to a position wherein the cap holes 416 are aligned with the vents 488. The bottle 410 is closed by rotating the cap holes 416 out of alignment with the vents 488. In this manner, the castellated neck 432 functions as a sifter, e.g., 22. As before, a lock ring 418 engages a plurality of ratchet lugs 440 to retain the cap 414 in a closed position prior to use and indicates to the consumer that the cap 414 has not been opened. Stop lugs 440 interact with cap lugs 442 to limit cap rotation between the opened and closed positions. The cap 414 is retained on the bottle neck 432 (while at the same time permitting rotation of the cap 414 relative to the bottle 412) by cap retainer bead 436 and cap bead 444. It should be noted that the cap retainer bead and/or the cap bead can be continuous or discontinuous as indicated by the slots or discontinuities 436*s* shown in FIG. 27. The features of the cap 414 and bottle neck 432 shown in FIGS. 26 and 27 could be used in conjunction with the features of the embodiments shown in FIGS. 8–13, 14–24 and 25, thus eliminating the sifter from each of these embodiments. For example, the rotatable sifter cap 264 shown in FIG. 18 may be altered by removing the occluder plate 223 and replacing it with the vents 488 shown in FIG. 26 and utilizing a cap 414 like that shown in FIG. 26. Alternatively, the cap 414 of FIG. 26 may be provided with the skirt 155 and squeeze tabs 154*a*, 154*b* of the second embodiment shown in FIGS. 8–13 to interact with a rotation stop 158*a*, 158*b* disposed on the bottle 412 proximate the neck 432.

It should be understood that the embodiments described herein are merely exemplary and that a person skilled in the art may make many variations and modifications without departing from the spirit and scope of the invention as defined in the appended claims. Accordingly, all such variations and modifications are intended to be included within the scope of the invention as defined in the appended claims.

We claim:

1. A dispenser bottle for containing and selectively dispensing a flowable material, comprising:

a bottle portion having an outlet through which the flowable material passes when dispensed from said dispenser bottle;

a cap covering said outlet, said cap having a cap hole therein and being rotatable relative to said outlet between an opened position wherein said cap hole is aligned with said outlet allowing the flowable material to pass therethrough to a closed position wherein said cap hole is out of alignment with said outlet preventing the flowable material from passing therethrough;

means for retaining said cap covering said outlet when in the closed position and when in the opened position; and a cap lock attached to at least one of said cap and said bottle portion, said cap lock having a locked position preventing the rotation of said cap relative to said outlet and an unlocked position wherein said cap is unconstrained by said cap lock from rotating relative to said outlet, said bottle having a neck defining said outlet and said cap having an occluder plate in which said cap hole is provided and a peripheral wall depending at substantially right angles from said occluder plate, said peripheral wall slidably coaxially embracing said neck, said cap further including an outer peripheral skirt depending from said occluder plate radially spaced from said peripheral wall, said peripheral skirt having a plurality of slits therein extending from a free edge of said peripheral skirt toward said occluder plate, said plurality of slits defining at least one squeeze tab depending from said cap, said squeeze tab having a relaxed position and a depressed position, said bottle portion further including a rotation stop, said squeeze tab abutting said rotation stop in the relaxed position to prevent rotation of said cap from said closed position, said squeeze tab clearing said rotation stop when in the depressed condition allowing said squeeze tab and said cap to rotate past said rotation stop to said opened position.

2. The dispenser bottle of claim 1, wherein said cap has two squeeze tabs.

3. The dispenser bottle of claim 1, wherein said rotation stop is radially spaced from said neck, said squeeze tab rotating between said rotation stop and said neck when said squeeze tab is in the depressed condition and said cap is in the opened position.

4. The dispenser bottle of claim 1, wherein said squeeze tab has a finger indentation to facilitate a user placing a finger on said squeeze tab.

5. The dispenser bottle of claim 1, further including a plurality of said squeeze tabs and a plurality of said rotation stops.

6. The dispenser bottle of claim 1, wherein said rotation stop includes an arcuate rail disposed on said bottle portion proximate said neck with a spacing therebetween defining an arcuate track and a stop rail extending from said arcuate rail toward said neck, said squeeze tab abutting against said arcuate rail when in the relaxed condition preventing rotation of said cap and entering said arcuate track between said arcuate rail and said neck when in the depressed condition, enabling said cap to be rotated to said opened position, said stop rail limiting the rotation of said cap when said squeeze tab abuts said stop rail.

7. The dispenser bottle of claim 6, wherein said stop rail is disposed at an end of said arcuate rail and extends therefrom generally radially and perpendicularly defining a generally "L" shaped configuration.

8. A dispenser bottle for containing and selectively dispensing a flowable material, comprising:

a bottle portion having an outlet through which the flowable material passes when dispensed from said dispenser bottle;

a cap covering said outlet, said cap having a cap hole therein and being rotatable relative to said outlet between an opened position wherein said cap hole is aligned with said outlet allowing the flowable material to pass therethrough to a closed position wherein said cap hole is out of alignment with said outlet preventing the flowable material from passing therethrough;

means for retaining said cap covering said outlet when in the closed position and when in the opened position; and a cap lock attached to at least one of said cap and said bottle portion, said cap lock having a locked position preventing the rotation of said cap relative to said outlet and an unlocked position wherein said cap is unconstrained by said cap lock from rotating relative to said outlet, said cap lock including a ring having a plurality of inwardly directed teeth, said ring being removably conjoined to said peripheral wall distal to said occluder plate, said bottle portion having a plurality of ratchet lugs matingly interdigitating with said plurality of teeth when said cap lock is conjoined to said peripheral wall, said interdigitating ratchet lugs and teeth preventing said cap from being rotated from the closed position to the opened position, said bottle portion having a neck defining said outlet and said cap having an occluder plate in which said cap hole is provided and a peripheral wall depending at substantially right angles from said occluder plate, said peripheral wall slidably coaxially embracing said neck, said cap further including at least one squeeze tab depending from said cap, said squeeze tab having a relaxed position and a depressed position, said bottle portion further including a rotation stop, said squeeze tab abutting said rotation stop in the relaxed position to prevent rotation of said cap from said closed position, said squeeze tab clearing said rotation stop when in the depressed condition allowing said squeeze tab and said cap to rotate past said rotation stop to said opened position.

9. The dispenser bottle of claim 8, wherein said squeeze tab is conjoined to said ring such that said squeeze tab is restrained from assuming the depressed condition prior to removal of said ring from said cap.

10. The dispenser bottle of claim 8, further comprising a cap retainer bead disposed about an exterior surface of said neck, a stop lug extending from said exterior surface, and a cap bead and a cap lug extending inwardly from said peripheral wall, said cap bead snapping over said cap retainer bead to retain said cap on said neck, said stop lug and said cap lug abutting when said cap is rotated to limit the range of motion of said cap relative to said bottle portion between and including said opened and closed positions.

11. The dispenser bottle of claim 10, wherein at least one of said cap retainer bead and said cap bead are discontinuous.

12. The dispenser bottle of claim 10, wherein at least one of said cap retainer bead and said cap bead are continuous.

13. A dispenser bottle for containing and selectively dispensing a flowable material, comprising:

a bottle portion having an outlet through which the flowable material passes when dispensed from said dispenser bottle;

a cap covering said outlet, said cap having a cap hole therein and being rotatable relative to said outlet between an opened position wherein said cap hole is aligned with said outlet allowing the flowable material to pass therethrough to a closed position wherein said cap hole is out of alignment with said outlet preventing the flowable material from passing therethrough;

means for retaining said cap covering said outlet when in the closed position and when in the opened position; and a cap lock attached to at least one of said cap and said bottle portion, said cap lock having a locked position preventing the rotation of said cap relative to said outlet and an unlocked position wherein said cap is unconstrained by said cap lock from rotating relative to said outlet said bottle portion having a neck defining said outlet and said cap having an occluder plate in which said cap hole is provided and a peripheral wall depending at substantially right angles from said occluder plate, said cap lock comprising a ring having inwardly directed teeth, said ring being removably conjoined to said peripheral wall distal to said occluder plate, said bottle portion having a ratchet lug matingly interdigitating with said teeth when said cap lock is conjoined to said peripheral wall, said interdigitating ratchet lug and teeth preventing said cap from being rotated from the closed position to the opened position.

14. The dispenser bottle of claim 13, wherein said ring is monolithically formed with said cap.

15. The dispenser bottle of claim 13, further including a plurality of stop lugs distributed on said exterior surface and a plurality of cap lugs distributed on said peripheral wall.

16. The dispenser bottle of claim 13, further including a plurality of inwardly directed teeth on said ring and a plurality of ratchet lugs on said bottle portion.

17. The dispenser bottle of claim 13, wherein said ring is conjoined to said cap at a frangible junction.

18. The dispenser bottle of claim 13, wherein said means for retaining includes a cap retainer bead disposed about an exterior surface of said neck and a cap bead extending inwardly from said peripheral wall, said cap bead snapping over said cap retainer bead to retain said cap on said neck, and further comprising a stop lug extending from said exterior surface, and a cap lug extending inwardly from said peripheral wall, said stop lug and said cap lug abutting when said cap is rotated to limit the range of motion of said cap relative to said bottle portion between and including said opened and closed positions.

19. The dispenser bottle of claim 18, wherein at least one of said cap retainer bead and said cap bead are discontinuous.

20. The dispenser bottle of claim 18, wherein at least one of said cap retainer bead and said cap bead are continuous.

21. The dispenser bottle of claim 13, wherein said outlet is castellated with a plurality of vents along an upper peripheral inside edge thereof, said cap having a plurality of cap holes that align with said vents when said cap is in the opened position.

22. The dispenser bottle of claim 13, further comprising a sifter occluding said outlet, said sifter being rotationally immobilized relative to said neck, said sifter having a sifter hole therein in communication with said outlet, said cap covering said sifter and said peripheral wall slidably coaxially embracing said neck.

23. A dispenser bottle for containing and selectively dispensing a flowable material, comprising:

a bottle portion having an outlet through which the flowable material passes when dispensed from said dispenser bottle;

a cap covering said outlet, said cap having a cap hole therein and being rotatable relative to said outlet between an opened position wherein said cap hole is aligned with said outlet allowing the flowable material to pass therethrough to a closed position wherein said cap hole is out of alignment with said outlet preventing the flowable material from passing therethrough;

means for retaining said cap covering said outlet when in the closed position and when in the opened position; and a cap lock attached to at least one of said cap and said bottle portion, said cap lock having a locked position preventing the rotation of said cap relative to said outlet and an unlocked position wherein said cap is unconstrained by said caplock from rotating relative to said outlet, said bottle portion having a neck defining said outlet and further comprising a sifter occluding said outlet and being rotationally immobilized relative to said neck, said sifter having a sifter hole therein in communication with said outlet, said cap covering said sifter and having an occluder plate in which said cap hole is provided, and a peripheral wall depending at substantially right angles from said occluder plate, said cap hole aligning with said sifter hole when in the opened position and out of alignment when in the closed position.

24. A dispenser bottle for containing and selectively dispensing a flowable material, comprising:

a bottle portion having an outlet therein;

a sifter having a generally cylindrical side wall, an open end and a dispensing end with a sifter opening therein, said sifter rotatably coupling to said bottle at said open end in communication with said outlet; and a cap coaxially and rotatably coupled to said sifter on said dispensing end, said cap having an occluder plate with a cap hole therein and a peripheral wall depending at substantially right angles from said cap occulder plate being rotatable relative to said sifter between an opened position wherein said cap hole is aligned with said sifter opening and a closed position wherein said cap hole is not aligned with said sifter opening.

25. The dispenser bottle of claim 24, wherein the bottle further comprises a cap lock, said cap lock comprises a ring having inwardly directed teeth, said ring being removably conjoined to said peripheral wall distal to said cap occluder plate, said sifter having a ratchet lug matingly interdigitating with said teeth when said cap lock is conjoined to said cap.

26. The dispenser bottle of claim 24, further comprising a stop lug extending from said exterior surface of said side wall of said sifter and a cap lug extending inwardly from said peripheral wall, said stop lug and said cap lug abutting when said cap is rotated to limit the range of motion of said cap relative to said sifter between and including said opened and closed positions.

27. The dispenser bottle of claim 27, further including a detent extending from one of said peripheral wall and said side wall, said detent interacting with one of said stop lug and said cap lug, respectively, to provide a resistance to turning of said cap relative to said sifter when transitioning from said opened position to said closed position.

28. The dispenser bottle of claim 24, wherein said sifter is rotatable 360 degrees on said neck.

29. The dispenser bottle of claim 24, wherein said sifter opening is in the form of at least one vent formed in the interior periphery of the sifter dispensing end.

30. The dispenser of claim 24, further comprising locking means for locking said cap in said closed position, said locking means being removable to permit said cap to assume the opened position.

31. A dispenser bottle for containing and selectively dispensing a flowable material, comprising:

a bottle portion having a neck defining an outlet therein;

a sifter having a generally cylindrical side wall, an open end and a dispensing end with a sifter opening therein, said sifter rotatably coupling to said bottle at said open end in communication with said outlet, said sifter having a sifter occluder plate over said dispensing end with a sifter hole therein, said sifter coaxially coupling to said neck, said sifter having a sifter retainer bead disposed about an exterior surface of said neck and said sifter having a mating sifter bead extending inwardly from an interior surface of said side wall proximate said open end, said sifter bead snapping over said sifter retainer bead to retain said sifter in rotatable relationship to said neck, said sifter having a cap retainer bead extending from an outer peripheral surface of said side wall proximate said sifter occluder plate; and a cap coaxially and rotatably coupled to said sifter on said dispensing end, said cap having a cap hole therein and being rotatable relative to said sifter between an opened position wherein said cap hole is aligned with said sifter opening and a closed position wherein said cap hole is not aligned with said sifter opening, said cap having a cap occluder plate in which said cap hole is provided, a peripheral wall depending at substantially right angles from said cap occluder plate and a cap bead extending inwardly from said peripheral wall, said cap bead snapping over said cap retainer bead to retain said cap on said sifter.

32. The dispenser bottle of claim 31, wherein at least one of said cap retainer bead and said cap bead are discontinuous.

33. The dispenser bottle of claim 31, wherein at least one of said cap retainer bead and said cap bead are continuous.

* * * * *